US005676481A

United States Patent [19]

Nicoll et al.

[11] Patent Number: 5,676,481

[45] Date of Patent: Oct. 14, 1997

[54] MARKING INSTRUMENTS

[75] Inventors: Roy Nicoll, Wokingham; Charles Christopher Packham, Crowthorne, both of England

[73] Assignee: Gillette Company, Boston, Mass.

[21] Appl. No.: 661,840

[22] Filed: Jun. 11, 1996

Related U.S. Application Data

[63] Continuation of Ser. No. 211,176, Mar. 21, 1994, abandoned.

[30] Foreign Application Priority Data

Sep. 26, 1991 [GB] United Kingdom ..... 9120517

[51] Int. Cl.[6] ..... B43K 5/18; B43K 8/04

[52] U.S. Cl. ..... 401/148; 401/206; 401/264

[58] Field of Search ..... 401/148, 206, 401/264, 214

[56] References Cited

U.S. PATENT DOCUMENTS

| | | | |
|---|---|---|---|
| 284,569 | 9/1883 | Nimmo | 401/4 |
| 802,627 | 10/1905 | Chrysler et al. . | |
| 2,029,152 | 1/1936 | Bonkowski . | |
| 2,102,749 | 12/1937 | Salvesen | 401/264 |
| 2,249,163 | 7/1941 | Nissen, Jr. . | |
| 2,271,602 | 2/1942 | Munroe | 401/264 X |
| 2,516,542 | 7/1950 | Blackman | 401/148 |
| 2,557,917 | 6/1951 | Schlesinger | 401/264 X |

(List continued on next page.)

FOREIGN PATENT DOCUMENTS

| | | | |
|---|---|---|---|
| 220924 | 4/1957 | Australia | 401/263 |
| 2100 | 5/1900 | Austria . | |
| 0413273A1 | 2/1991 | European Pat. Off. . | |
| 0476492 | 10/1991 | European Pat. Off. . | |
| 942622 | 9/1948 | France | 401/264 |
| 2216125 | 2/1973 | France . | |
| 2604640 | 10/1987 | France . | |
| 926054 | 4/1955 | Germany . | |

(List continued on next page.)

*Primary Examiner*—Steven A. Bratlie
*Attorney, Agent, or Firm*—Chester Cekala

[57] ABSTRACT

A marking instrument, e.g. a fiber tip pen, roller ball pen, or highlighter pen, has a feed device which conducts marking liquid from the reservoir chamber (17) to the marking tip supported by an elastomeric diaphragm (6) which partly confines the reservoir chamber and forms a valve with the feed device so that when tip is applied against a surface the feed device retracts causing the diaphragm (6) to pressurize the liquid in the reservoir and open the valve whereby liquid is pumped to the tip.

1 Claim, 8 Drawing Sheets

U.S. PATENT DOCUMENTS

| | | | |
|---|---|---|---|
| 2,606,529 | 8/1952 | Wagner . | |
| 2,762,337 | 9/1956 | Beckwith . | |
| 2,783,488 | 3/1957 | Jockers . | |
| 2,870,742 | 1/1959 | Hackmyer | 120/45.4 |
| 2,874,679 | 2/1959 | Zepelovitch | 401/148 |
| 2,913,749 | 11/1959 | Ayres . | |
| 2,996,750 | 8/1961 | Cholet | 15/566 |
| 3,153,804 | 10/1964 | Silver . | |
| 3,233,275 | 2/1966 | Hansen et al. . | |
| 3,355,239 | 11/1967 | Albrecht | 401/148 |
| 3,397,939 | 8/1968 | Berry . | |
| 3,420,610 | 1/1969 | Malm | 401/112 |
| 3,424,537 | 1/1969 | Henriksen | 401/142 |
| 3,468,611 | 9/1969 | Ward | 401/186 |
| 3,656,857 | 4/1972 | Seregely . | |
| 3,792,932 | 2/1974 | Henriksen . | |
| 4,157,874 | 6/1979 | Durand . | |
| 4,364,684 | 12/1982 | Kohno et al. . | |
| 4,453,651 | 6/1984 | Braithwaite et al. . | |
| 4,480,940 | 11/1984 | Woodruff | 401/206 |
| 4,509,876 | 4/1985 | Hori . | |
| 4,693,623 | 9/1987 | Schwartzman . | |
| 4,848,947 | 7/1989 | Kremer et al. | 401/206 |
| 4,973,180 | 11/1990 | Hori . | |
| 5,073,057 | 12/1991 | Lathrop et al. | 401/206 |
| 5,249,875 | 10/1993 | Hori et al. . | |
| 5,277,510 | 1/1994 | Okamoto et al. . | |
| 5,332,326 | 7/1994 | Hori . | |

FOREIGN PATENT DOCUMENTS

| | | |
|---|---|---|
| 59-120184 | 8/1984 | Japan . |
| 61-179799 | 8/1986 | Japan . |
| 61-192884 | 12/1986 | Japan . |
| 62-199492 | 9/1987 | Japan . |
| 2-20982 | 2/1990 | Japan . |
| 2-36398 | 8/1990 | Japan . |
| 2-36399 | 8/1990 | Japan . |
| 3-13396 | 1/1991 | Japan . |
| 3-73398 | 3/1991 | Japan . |
| 3-70989 | 7/1991 | Japan . |
| 4-85094 | 3/1992 | Japan . |
| 4-119897 | 4/1992 | Japan . |
| 4-119898 | 4/1992 | Japan . |
| 4-332697 | 11/1992 | Japan . |
| 4-332698 | 11/1992 | Japan . |
| 5-7822 | 1/1993 | Japan . |
| 2052397 | 6/1980 | United Kingdom . |
| 2170697 | 2/1985 | United Kingdom . |
| WO89/08563 | 3/1989 | WIPO . |

MARKING INSTRUMENTS

This is a continuation of application Ser. No. 08/211,176, filed Mar. 21, 1996 now abandoned.

This invention relates to marking instruments and is especially concerned with such instruments, e.g. pens and markers, having a tip to which a liquid is supplied from a reservoir to be applied onto a substrate, such as a sheet of paper, by means of the tip which is moved over the surface of the substrate to leave a liquid trace.

In the case of pens, a variety of different tip forms are known in the art and include rolling balls, nibs, wire nibs, fibre tips, felt tips and others. For markers broad blade felt or fibre tips are most common due to the desire to lay down a wide band of liquid. Many of the known tips and the feed mechanisms which deliver and control the flow of liquid to the tips suffer from one or more of the following drawbacks:- i) dry-out as a result of liquid drying up at the tip and/or in the feed mechanism, with the result that the marker is slow and/or difficult to prime, which can be very inconvenient to the user;

ii) drops of liquid can be thrown from the tip if the instrument is dropped or subjected to a flicking action;

iii) ink leakage can occur if the pen is subjected to temperatures and/or pressure changes;

iv) unless the surface of the substrate is smooth, there can be a harsh feel due to the tip being rigidly fixed relative to the body which is gripped in the hand of the user.

The present invention aims to provide a marking instrument which alleviates these drawbacks and an instrument according to the invention comprises a body, a liquid reservoir chamber defined within the body, a liquid feed device defining a channel for conducting liquid from the reservoir to a marking tip, valve means for controlling communication between the reservoir chamber and the feed channel, and an elastomeric member partly confining the reservoir chamber and supporting the feed device with respect to the body, whereby the feed device is retractable relative to the body under a force exerted against the tip. By applying the tip against a substrate and in response to such retraction the reservoir chamber is pressurised by deflection of the elastomeric member and the valve means is opened to allow liquid to enter the feed channel from the reservoir.

In the normal condition, i.e. when there is no force exerted on the tip to retract the feed device, the valve means is closed and flow of liquid from the reservoir to the tip is positively precluded. The retraction of the feed device caused by applying the tip against a substrate lightly pressurises the reservoir and has the effect of pumping liquid into the feed channel to ensure a rapid supply of ink to the tip even in a situation where liquid may have dried up in the delivery system between the reservoir and the tip. The elastomeric member provides an effective hydraulically damped spring suspension for the tip so that the tip is easily able to follow surface irregularities with the result that the instrument has an improved feel compared with prior art instruments with fixed tips.

In accordance with a preferred and especially advantageous feature the valve means is defined by direct cooperation between the elastomeric member and the feed device. The feed device may have a seat with at least one port Which is normally closed by the elastomeric member and which is opened upon the elastomeric member flexing under displacement of the feed device. A valve arrangement of this form is simple in operation and inexpensive to manufacture. The elastomeric member serves several functions including that of the valve member.

In a particularly convenient construction the feed device defines a radially directed valve port and the elastomeric member has an aperture through which the feed device extends so that an inner peripheral surface of the elastomeric member cooperates with the valve seat.

Marking instruments constructed in accordance with the invention may be equipped with a variety of different tips and the invention is not limited to any particular type of tip.

A more complete understanding of the invention will be had from the following detailed description given with reference to the accompanying drawings in which:-

Figure 12:
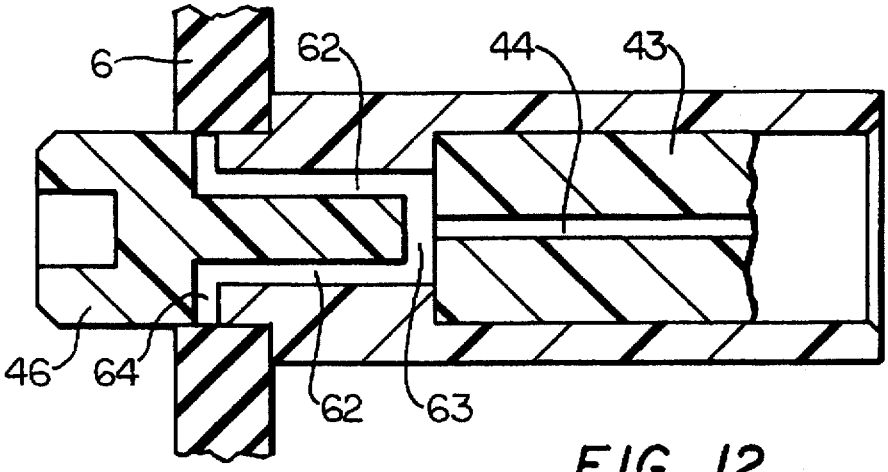
Figure 13:
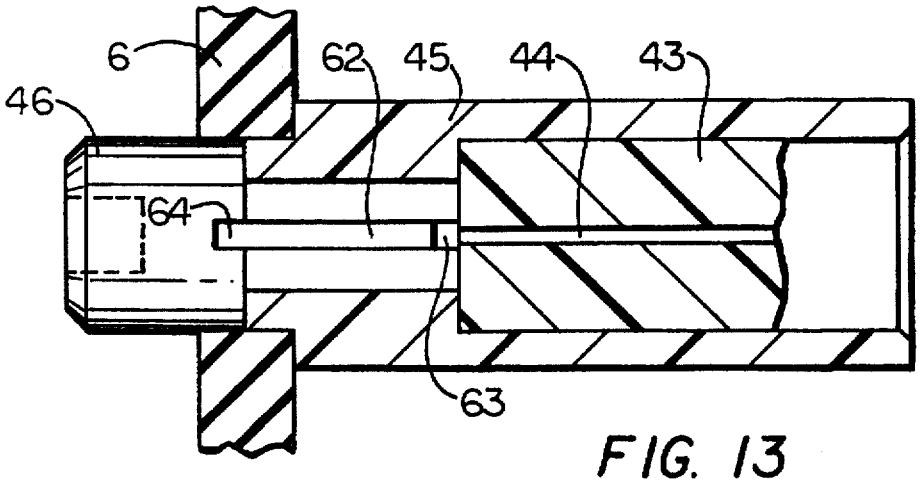

FIG. 12 in scrap cross-section showing a modified porting arrangement;

FIG. 13 shows the device of FIG. 12 partly in plan; and

Figure 14:
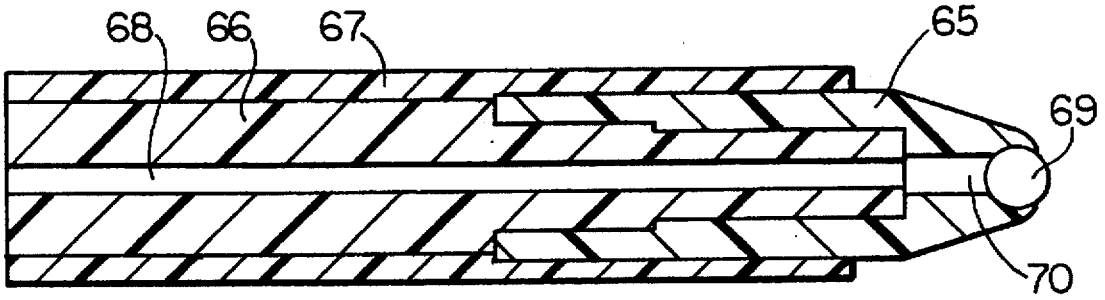
Figure 15:
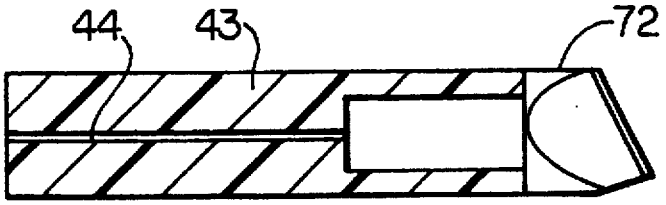
Figure 16:
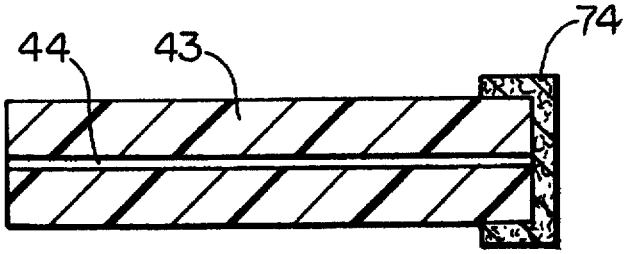

FIGS. 14, 15 and 16 illustrate alternative tip constructions.

Figure 1:
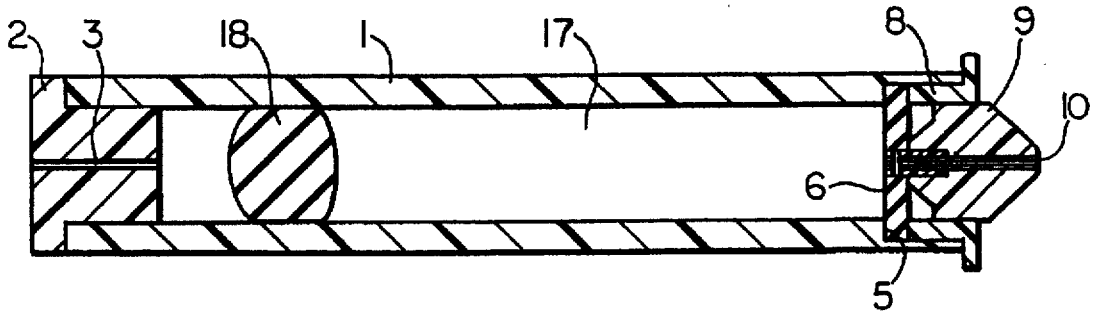
FIG. 1 is an axial section through a marking instrument embodying the invention.
Figure 2:
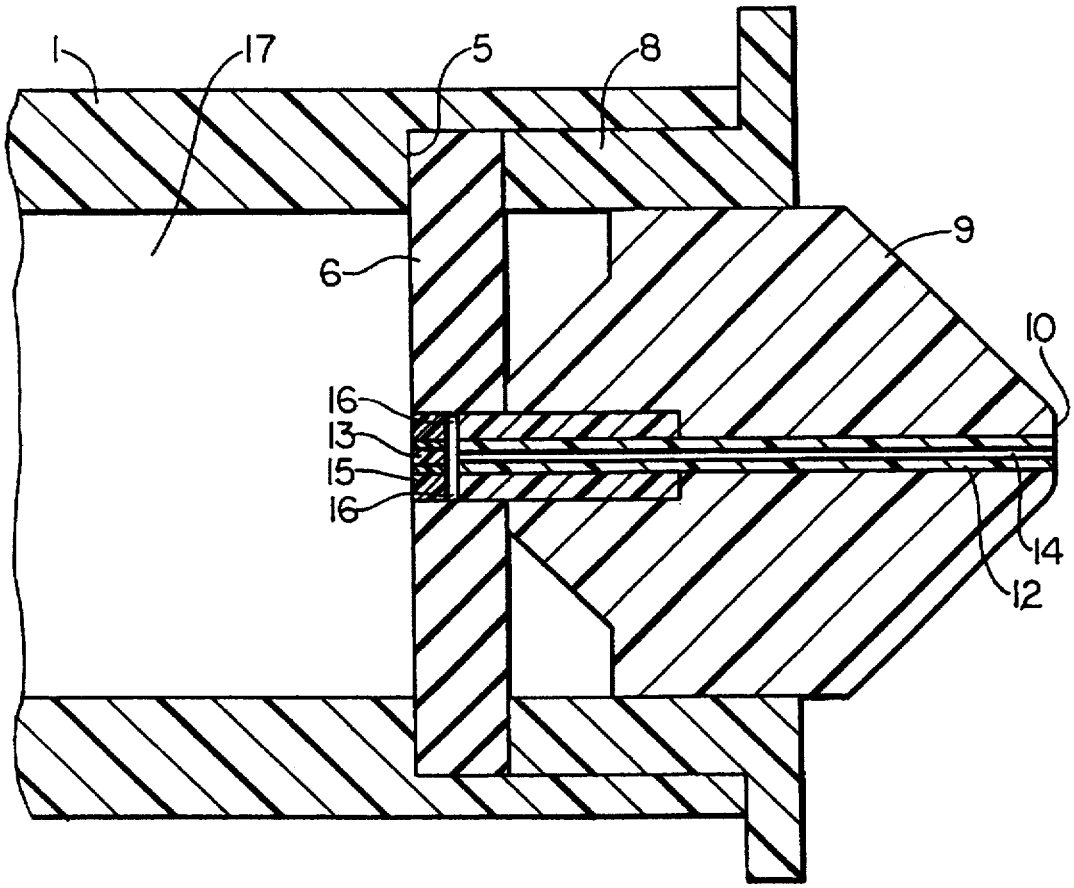
FIG. 2 is an enlarged scale cross-section of the forward end part of the instrument.

The marking instrument shown in FIGS. 1 and 2 has a body comprising a cylindrical barrel 1 closed at its rear end by a plug 2 provided with an air venting hole 3. At its forward end the barrel has a counterbore terminating in a forwardly directed radial shoulder 5 which defines a seat for the peripheral portion of an elastomeric member 6 which has the form of a circular disc washer or diaphragm made of silicone rubber. The washer is held clamped against the shoulder 5 by a sleeve insert 8 fitted tightly into the end of the barrel. Received in the sleeve and guided thereby for axial sliding movement is a piston 9 having opposed frustoconical ends, the forward end defining a marking tip 10 for contact with a substrate surface and the inner end defining a reduced central surface for contact with the washer 6. A capillary restrictor 12 extends through an axial bore formed in the piston to define a capillary channel 14 for delivering a controlled flow of marking liquid to the tip 10, this restrictor projecting rearwardly of the piston. Closely surrounding a rear end portion of the restrictor is a seat 15 which acts as a valve seat for cooperation with a valve member constituted by an inner edge of the washer 6. Thus, the sections of the restrictor 12 and sleeve 15 protruding from the rear end of the piston extend through a central aperture in the washer, and these sections are provided with a plurality, e.g. four radial ports 16 which communicate with the capillary channel of the restrictor and open at the surface of the valve sleeve. The inner end of the channel 14 is sealed off by a plug 13. In the normal condition when the marker is not being used, the washer 6 covers and closes the ports 16 from communication with a liquid reservoir chamber 17 for marker fluid defined in the barrel and confined at the forward end by the washer 6. The rear end of the reservoir chamber is closed by an ink follower 18, such as a grease plug or an elastomeric member, which moves along the barrel behind the fluid as it is used up so that measures to allow air to enter the reservoir chamber are not necessary. In the normal condition of the pen the valve is tightly closed and the fluid within the reservoir chamber 17 is protected against drying out. In addition, if the instrument is flicked or dropped fluid is prevented from passing from the reservoir chamber.

When the instrument is to be used and the tip 10 is applied against a substrate surface, the piston 9 retracts into the barrel against the resilience of the washer 6, the rear end of the piston pressing on the inner edge region of the washer and causing the washer to flex inwardly. The resilient deflection of the washer has two important effects. Firstly, the aperture in the washer expands and the ports 16 are uncovered to open up communication between the reservoir chamber 17 and the capillary channel 14, thereby allowing fluid to flow from the reservoir to the tip to be laid down onto the substrate. Secondly, the movement of the washer lightly pressurises the fluid within the reservoir chamber producing a pumping action to ensure a rapid delivery of fluid to the tip. Of course, when the force on the tip is removed e.g. due to it being lifted away from the substrate, the restoring force applied by the elastomeric washer displaces the piston forwardly and ensures the valve closes again.

Figure 3:
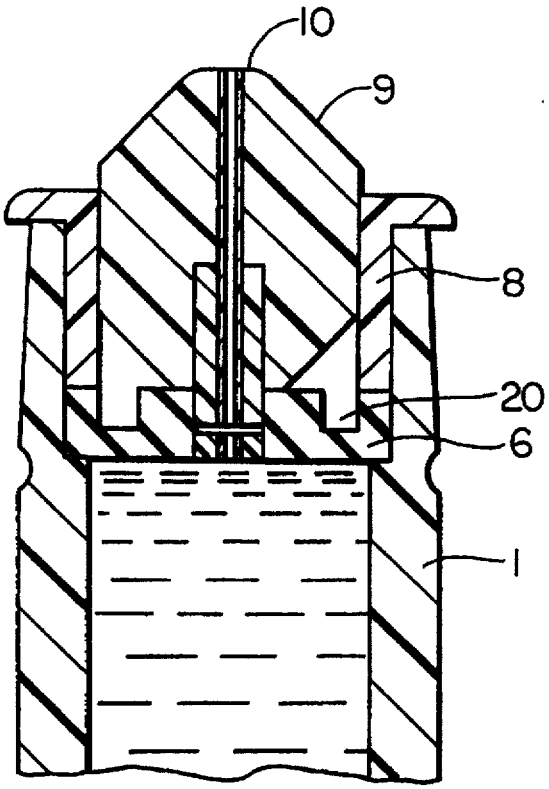
FIGS. 3 and 4 are views similar to FIG. 2 and illustrating modified forms of elastomeric member.
Figure 4:
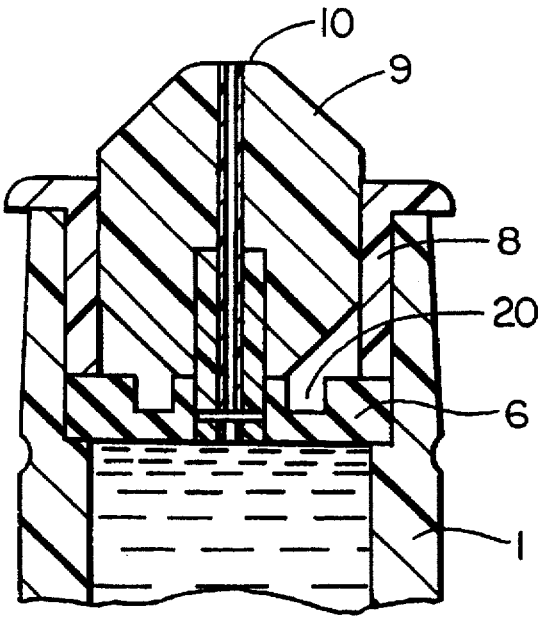

As shown in FIG. 2 the washer 6 has the form of a plain disc, but this is not essential and the elastomeric member may be configured as required to obtain the desired flexing characteristics for opening and closing the valve and the resistance against tip retraction. In FIGS. 3 and 4 for example the washers are shown to have annular grooves 20, in the first case located near the outer edge and in the second case nearer the inner edge.

Figure 5:
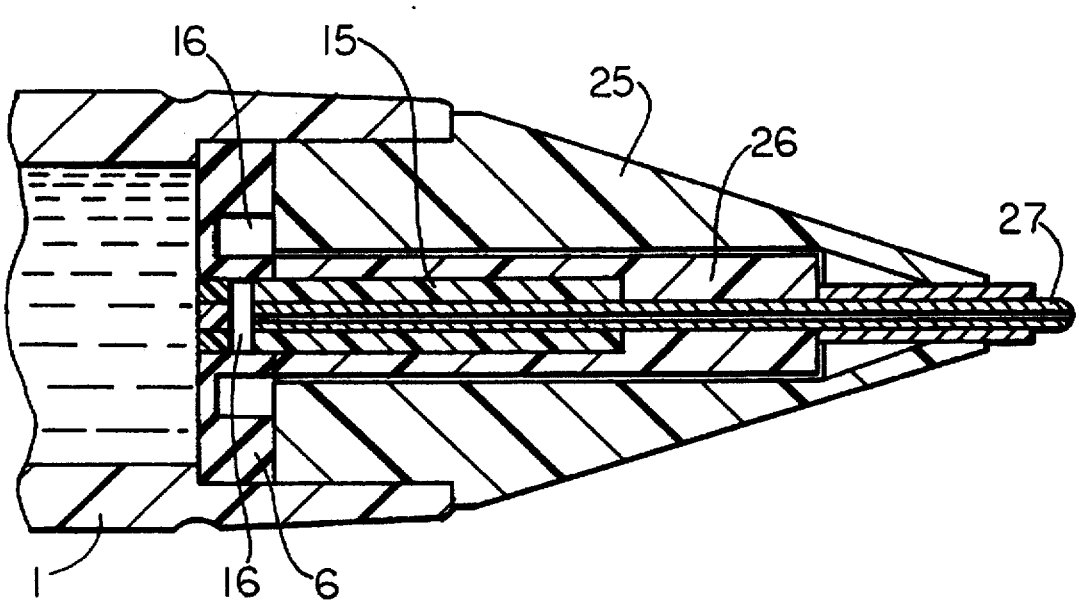
FIG. 5 is an axial cross-section through a forward end portion of a fibre tip pen according to the invention, the valve being shown in a closed condition.
Figure 6:
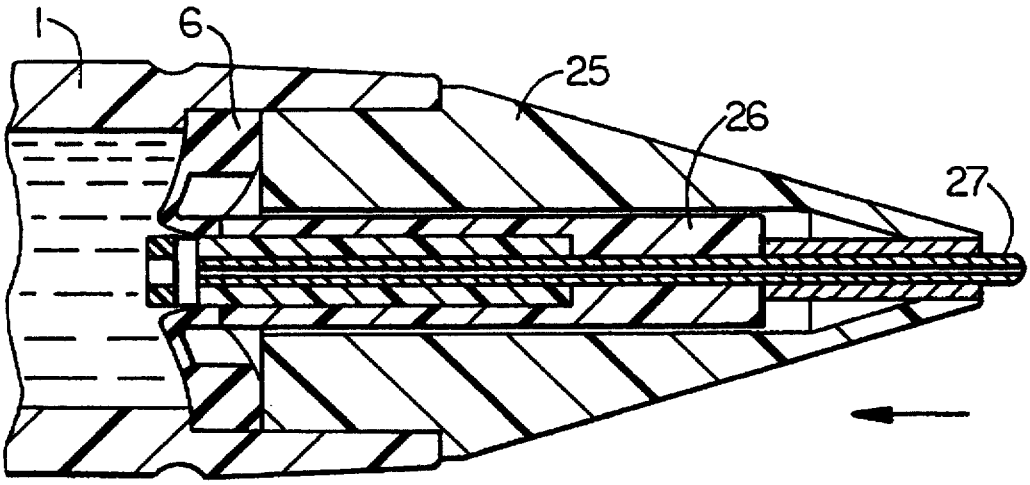
FIG. 6 is a view corresponding to FIG. 5 but with the valve shown open.

Shown in FIGS. 5 and 6 is a fibre tip pen embodying the invention. The construction is largely the same as that of the marker described above. The washer is held in the barrel by a nose cone 25 fitted in the forward end and having an axial bore in which a cylindrical piston 26 is accommodated. Extending through the piston is a fibre rod 27 with a free end protruding through the leading end of the nose cone to define a writing tip. The ports 16 in the valve sleeve 15 serve to deliver ink from the reservoir chamber to the rear end of the fibre rod when the valve is opened by a force exerted on the writing tip causing the feed assembly consisting of the fibre rod, piston and valve sleeve to retract and the washer 6 to flex, as shown in FIG. 6.

Figure 7:
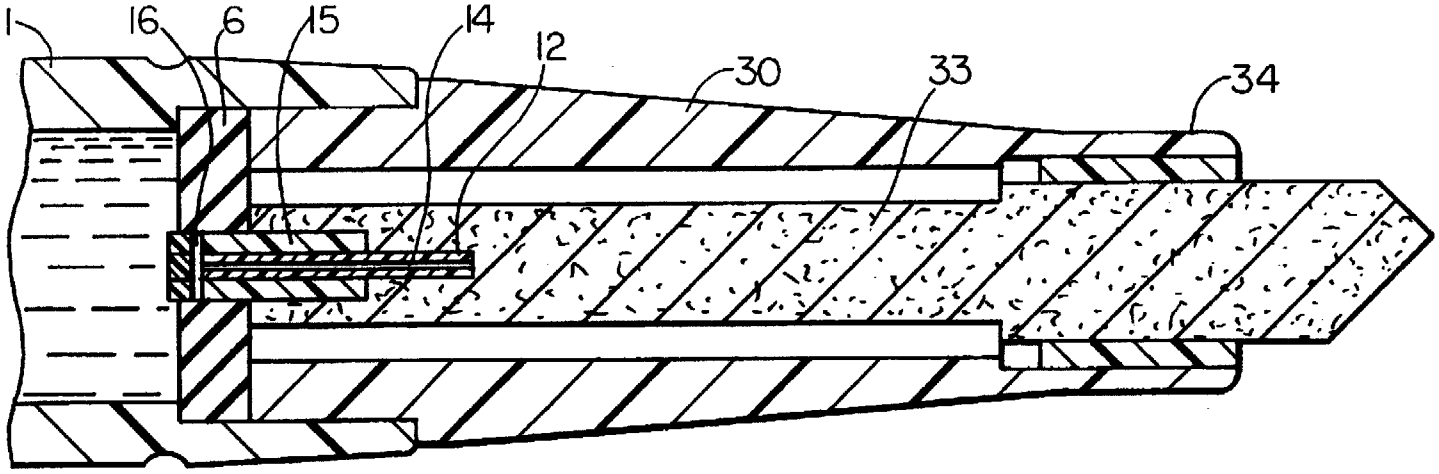
FIG. 7 is a longitudinal cross-section through a forward end part of a fibre tip highlighting marker in accordance with the invention, the valve being shown closed.
Figure 8:
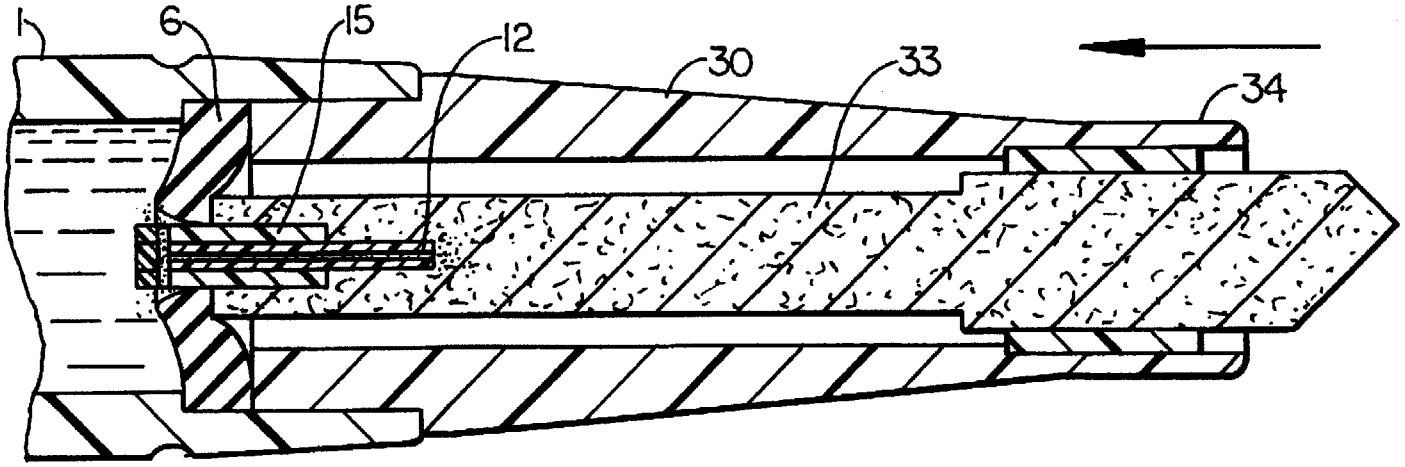
FIG. 8 shows the fibre tip marker of FIG. 7 with the valve opened.

Illustrated in FIGS. 7 and 8 is a fibre tip highlighter constructed according to the invention. Again the valve arrangement is essentially as described with reference to FIGS. 1 to 4. The washer 6 is trapped within the forward end of the barrel by a tubular nose piece 30 fitted to the barrel. A fibre core 33 is located within the nose piece and includes a head portion which is slidably guided relative to the nose piece by a bearing 34, the free end of the head being arranged to protrude from the nose piece and being shaped to define a broad edge for laying down a wide line of marker fluid. The rear end of the core bears on the central region of the washer 6 and is recessed to accommodate a central tube defining a feed channel 14 and the valve sleeve 15 surrounding the tube. When the marker tip is pressed against a surface, the core 33 retracts and causes the elastomeric washer 6 to flex rearwardly so that the valve is opened and the reservoir chamber is pressurised, whereby fluid is supplied to the core via the ports 16 and feed channel 14 and flows along the ducts in the core to the tip to be laid down thereby.

Figure 9:
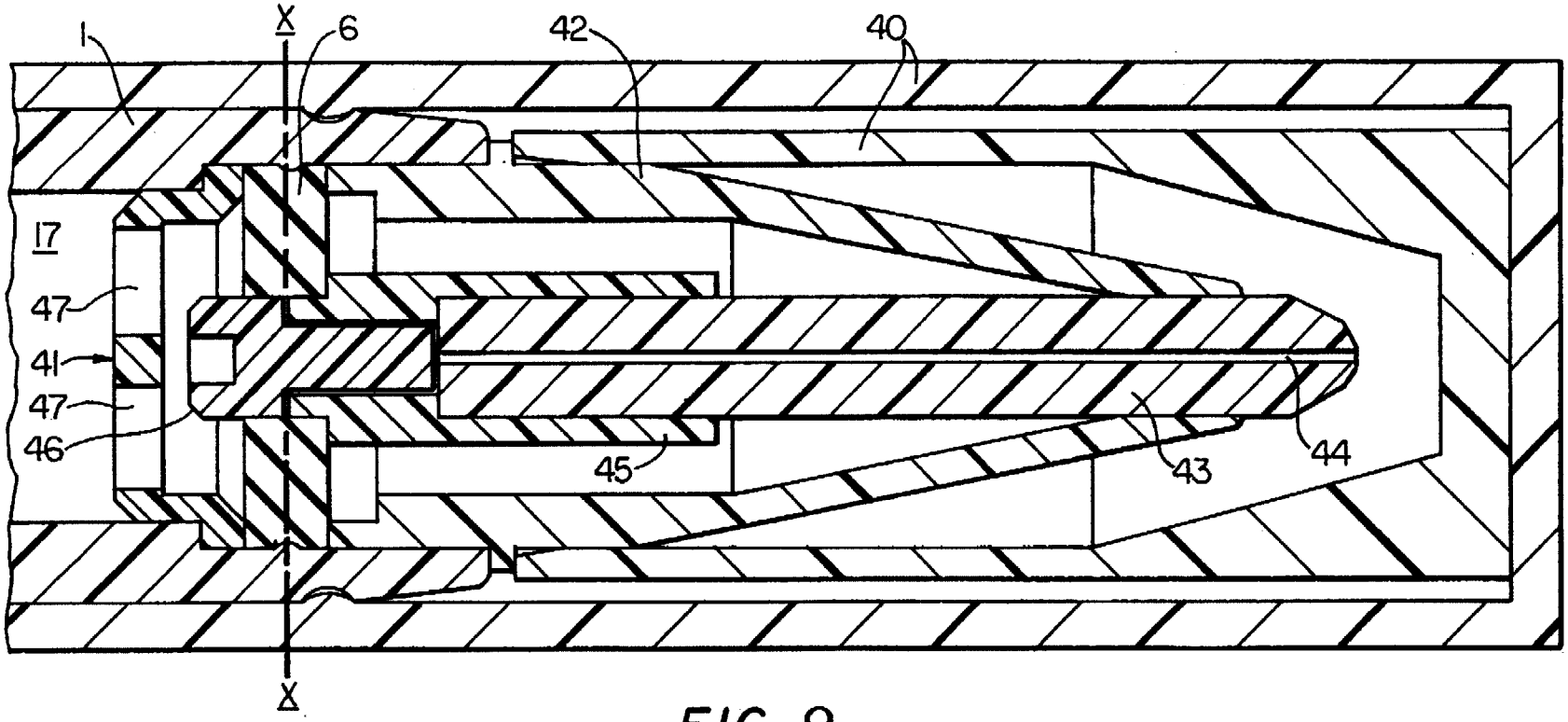
FIG. 9 is a longitudinal cross-section through forward end part of another pen embodying the invention.
Figure 10:
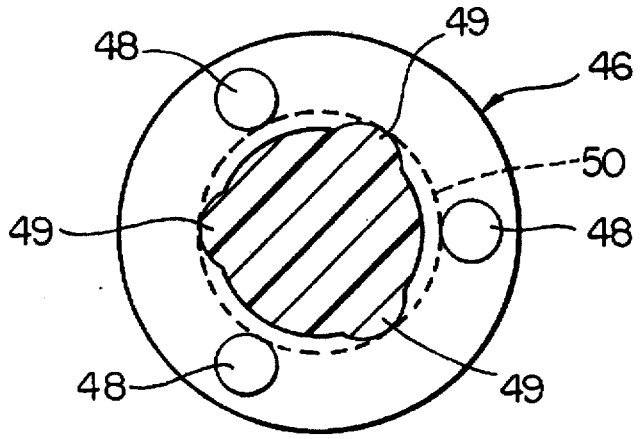
FIG. 10 is a cross-section through the feed device of the pen shown in FIG. 9, taken in the plane X—X.

FIG. 9 shows a pen embodying the invention with the tip enclosed by a detachable cap 40. As in the previous embodiments the barrel 1 is counterbored and receives an elastomeric washer 6. Between the washer and the barrel shoulder, however, is held the flange of a stop member 41, the form and function of which are described further below. The washer is retained in the barrel by a nose cone 42 which has a central hole at its apex. Slidably guided in this hole is a rod 43 having an axial capillary duct 44. The leading end of the rod projecting from the nose cone defines a writing tip, although the rod may in alternative embodiments serve to deliver ink to a further tip component located at its end. The rear end of the rod 43 is engaged in a sleeve 45 having a stepped bore and an external shoulder which abuts the washer 6 around its central aperture. Fitted into the rear end of the sleeve which extends about half way through the washer 6 is a pin 46 having a stem portion received in the sleeve bore and an enlarged head. Formed on the radial shoulder between the stem and head are spacer pips 48 (FIG. 10) so that a gap defining a radially directed port is defined between this shoulder and the confronting end face of the sleeve. Furthermore, the stem of the pin has longitudinal ribs 49 spaced therearound so that longitudinal channels are defined between the stem and the inner surface (indicated by broken line 50 in FIG. 10) of the sleeve for conducting ink from the radial port to the axial duct of the rod 43. The sleeve 45 and pin 46 combine to form a valve seat with which the inner peripheral portion of the washer 6 cooperates to control ink flow to the writing tip from the reservoir chamber 17 enclosed in the barrel immediately behind the washer 6. The head of the pin projects rearwardly of the washer and its rearward movement is limited by the stop member 41 which is generally cup-shaped with holes 47 in its planar end wall for passage of ink.

Figure 11:
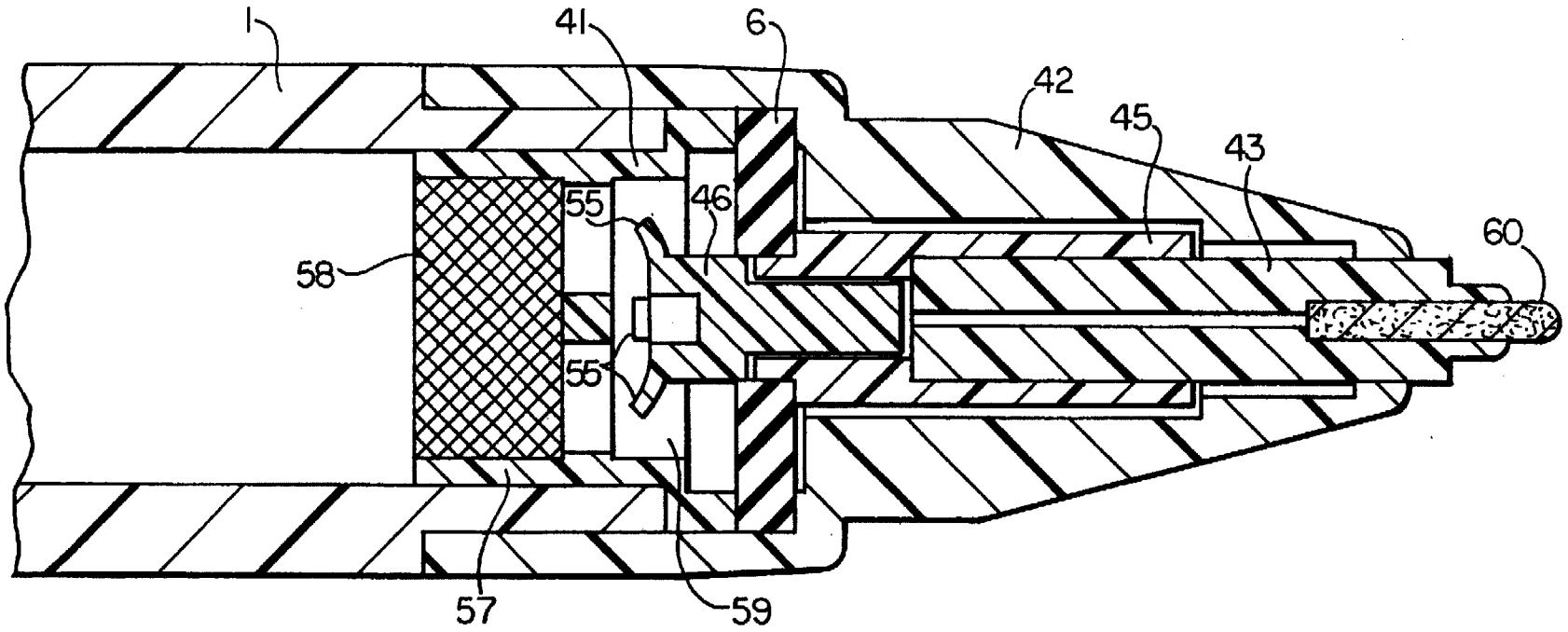
FIG. 11 is a view similar to FIG. 9 illustrating a modified pen construction.

When the writing tip is pressed against a surface to be written on, the rod 43 retracts slightly moving with it the valve seat formed by the sleeve 45 and pin 46 so that the inner periphery of the washer is deflected rearwardly thereby pressurising the ink in the reservoir chamber and opening the valve to permit the ink to pass to the writing tip. By limiting the rearward displacement, the stop member 41 provides some control over the pumping effect and hence the delivery of ink to the tip. As shown the stop member is rigid and defines a fixed stop, but it could be made resilient to allow some additional rearward displacement under increased forces applied against the writing tip. Alternatively, resilient spring means may be provided on the pin 46 for engaging the stop member to provide a gradually increasing resistance to further rearward displacement of the writing tip as the pin 46 approaches the stop member. In this way a sudden stop to retraction of the writing tip will be avoided. The embodiment shown in FIG. 11 is provided with such spring means in the form of leaf spring elements 55 integral with the pin 46 and projecting outwardly therefrom in rearwardly inclined directions. In this embodiment the periphery of the washer 6 is held between the forward end of the stop member 41 and an internal shoulder of the nose piece 42 which extends over a front end portion of the barrel 1. The stop member has a rearward extension 57 within which is housed a porous pad 58 which serves as a damper. Thus, when the writing tip is retracted and the central portion of the washer is deflected rearwardly, flow of marker fluid from the sub-chamber 59 defined between the pad 58 and the washer to the main chamber 17 behind the pad is impeded by the pad to enhance the initial pressurisation of the fluid in the sub-chamber and hence flow of this fluid to the writing tip through the opened valve. It will be appreciated that other means, such as a valve could be used instead of the pad to enhance fluid pressurisation and flow to the tip.

Another difference between the pen of FIG. 11 and that of FIG. 9 is that the rod 43 is fitted with a relatively short fibre rod 60 which defines the writing tip. This construction allows the feed channels on the upstream of the tip 60, i.e. the channel 44 and the channels defined between the sleeve 45 and the pin 46 to have larger flow areas, which facilitates effective pumping of fluid all the way to the tip and which can help to avoid any risk of the channels becoming blocked due to dry out of marking fluid in the channels during extended periods of non-use. FIGS. 12 and 13 illustrate a modified pin and sleeve assembly in which large porting is conveniently provided for. The stem portion of the pin 46 has a close fit in the sleeve and is provided with two diametrically opposite longitudinal grooves 62 running the full length of the stem. The forward ends of these grooves are interconnected by a groove 63 extending across the end face of the pin, this groove also being in communication with the channel 44 passing through the extruded rod 43. The rear ends of the longitudinal grooves 62 connect with radial grooves 64 in the shoulder of the pin, these grooves defining the valve ports which are controlled by the washer 6.

It will be appreciated that the precise form of the tip and the feed mechanism for delivering fluid to the tip from the valve are not important and hence the invention is applicable to a wide variety of different types of marking instrument. Shown in FIG. 14 is a roller ball tip assembly which may be fitted into the sleeve 45 of the pens shown in FIGS. 9 and 11 in place of the rod 43. A ball housing 65 is telescoped together with a feed rod 66 within a tubular case 67. The feed rod has an axial bore 68 which conducts marker fluid to the ball 69. As shown a small secondary reservoir 70 is defined by the ball housing immediately behind the ball but this may not be needed or could be given a greater volume if required. FIG. 15 shows an alternative tip construction for a highlighter pen. The rod 43 has a counterbore at its forward end and a fibre tip 72 has a spigot inserted into the counterbore and an enlarged head with a chisel blade edge for laying down a broad line. An even more simple construction is depicted in FIG. 16 where the forward end of the rod 43 is fitted with an overcap 74 of porous material forming a pad for applying fluid to a substrate surface.

We claim:

1. A marking instrument comprising a body, a reservoir chamber defined within the body, a liquid feed device having a feed channel for conducting liquid from the reservoir chamber to a marking tip formed at one end of the feed device, and valve means for controlling communication between the reservoir chamber and the feed channel, said valve means including an elastomeric member partly confining the reservoir chamber and located adjacent a portion of the liquid feed device, whereby the liquid feed device is retractable relative to the body under a force exerted against the marking tip, and in response to such retraction the reservoir chamber is first pressurized by deflection of the elastomeric member and the feed channel is thereafter opened to said reservoir chamber to allow liquid to enter the feed channel from the reservoir chamber, said valve means further including a valve seat provided on the feed device, a portion of the elastomeric member arranged to cooperate with the valve seat, said valve seat having at least one port opening in fluid communication between said feed channel and said reservoir chamber when said liquid feed device is retracted relative to said body under a force exerted against said marking tip, said port being closed by said cooperating portion of said elastomeric member when said force is no longer exerted against said marking tip.

* * * * *